US008225424B2

(12) United States Patent
Grilliot et al.

(10) Patent No.: US 8,225,424 B2
(45) Date of Patent: Jul. 24, 2012

(54) HIGH VISIBILITY SAFETY APPAREL

(75) Inventors: William L. Grilliot, West Milton, OH (US); Mary I. Grilliot, West Milton, OH (US); William L. Grilliot, Jr., Dayton, OH (US); Patricia K. Waters, Tipp City, OH (US)

(73) Assignee: Honeywell International Inc., Morristown, NJ (US)

( * ) Notice: Subject to any disclaimer, the term of this patent is extended or adjusted under 35 U.S.C. 154(b) by 428 days.

(21) Appl. No.: 12/510,779

(22) Filed: Jul. 28, 2009

(65) Prior Publication Data

US 2010/0031416 A1 Feb. 11, 2010

Related U.S. Application Data

(60) Provisional application No. 61/188,611, filed on Aug. 8, 2008.

(51) Int. Cl.
*A41D 1/04* (2006.01)

(52) U.S. Cl. ..... 2/102

(58) Field of Classification Search ..... 2/81, 93–97, 2/247, 249, 250, 102, 457, 458
See application file for complete search history.

(56) References Cited

U.S. PATENT DOCUMENTS

| | | | | | |
|---|---|---|---|---|---|
| 2,982,105 | A * | 5/1961 | Akers | 405/186 |
| 3,135,098 | A * | 6/1964 | Root | 405/186 |
| 4,438,764 | A * | 3/1984 | Eppolito | 128/205.22 |
| 4,739,913 | A * | 4/1988 | Moore | 224/643 |
| 4,964,405 | A * | 10/1990 | Arnoth | 128/205.17 |
| 4,998,654 | A * | 3/1991 | Bruzek et al. | 224/607 |
| 5,188,267 | A * | 2/1993 | Sargent et al. | 2/95 |
| 5,370,113 | A * | 12/1994 | Parsons | 128/205.22 |
| 5,400,934 | A * | 3/1995 | Ducros | 224/148.2 |
| 5,572,991 | A * | 11/1996 | Grilliot et al. | 128/201.29 |
| 5,784,719 | A * | 7/1998 | Robinson | 2/94 |
| 5,806,097 | A * | 9/1998 | Grilliot et al. | 2/81 |
| 5,887,585 | A * | 3/1999 | Dusenbery | 128/202.14 |
| 6,354,295 | B1 * | 3/2002 | Hasson, Jr. | 128/205.22 |
| 6,647,600 | B1 * | 11/2003 | Jost et al. | 24/442 |
| 6,820,280 | B1 * | 11/2004 | Atallah et al. | 2/102 |
| 7,394,387 | B2 * | 7/2008 | Noonchester | 340/573.1 |
| 7,631,364 | B2 * | 12/2009 | Culler et al. | 2/2.17 |
| 7,788,736 | B2 * | 9/2010 | Gollin | 2/94 |
| 7,793,360 | B2 * | 9/2010 | Blauer et al. | 2/81 |
| 8,035,525 | B2 * | 10/2011 | Noonchester | 340/573.1 |
| 2009/0229613 | A1 * | 9/2009 | Grilliot et al. | 128/205.22 |

* cited by examiner

*Primary Examiner* — Danny Worrell
(74) *Attorney, Agent, or Firm* — Wood, Phillips, Katz, Clark & Mortimer

(57) ABSTRACT

A high visibility safety vest for use with an air/oxygen bottle such as used with a SCBA. The vest includes a torso covering portion of high visibility material. The torso covering portion includes a back panel with an air/oxygen bottle receiving cover of the high visibility material formed in the back panel to extend therefrom and cover an air/oxygen bottle of a SCBA worn by a wearer of the vest.

14 Claims, 3 Drawing Sheets

HIGH VISIBILITY SAFETY APPAREL

CROSS-REFERENCE TO RELATED APPLICATIONS

This application claims the benefit of the filing date of U.S. Provisional Application No. 61/188,611, filed Aug. 8, 2008, which is hereby incorporated by reference.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to high visibility safety apparel.

BACKGROUND OF THE INVENTION

Federal regulations require that all workers within the right-of-way of a federal aid highway who are exposed either to traffic or to construction equipment within the work area wear high-visibility safety apparel. This requirement applies to firefighters and other emergency workers who are often required to wear other highly specialized protective garments, such as fire, heat, chemical and/or biohazard resistant protective garments depending upon the particular emergency situation they are responding to, and are sometimes required to also wear specialized breathing apparatus, such as a self-contained breathing apparatus (SCBA) having a backpack mounted oxygen/air tank.

SUMMARY OF THE INVENTION

In accordance with one feature of the invention, a high visibility safety vest is provided for use with an air/oxygen bottle such as used with a SCBA. The vest includes a torso covering portion of high visibility material. The torso covering portion includes a back panel with an air/oxygen bottle receiving cover of the high visibility material formed in the back panel to extend therefrom and cover an air/oxygen bottle of a SCBA worn by a wearer of the vest.

As one feature, the cover includes an expandable portion having an unexpanded state wherein the expandable portion lays flat against the remainder of the back panel and an expanded state wherein the expandable portion extends away from the remainder of the back panel to extend around an air/oxygen bottle worn by a wearer of the vest.

In one feature, the expandable portion includes at least one pleat.

In accordance with one feature of the invention, a high visibility safety vest is provided for use with an air/oxygen bottle such as used with a SCBA. The vest includes a torso covering portion of high visibility material. The torso covering portion includes an expandable portion of the high visibility material located in the back of the torso covering portion and having an unexpanded state wherein the expandable portion lays flat with the remainder of the back against a wearer, and an expanded state wherein the expandable portion extends from the remainder of the back to cover an air/oxygen bottle worn by a wearer of the vest.

Other objects, features, and advantages of the invention will become apparent from a review of the entire specification, including the appended claims and drawings.

DETAILED DESCRIPTION OF THE PREFERRED EMBODIMENT

Figure 2:
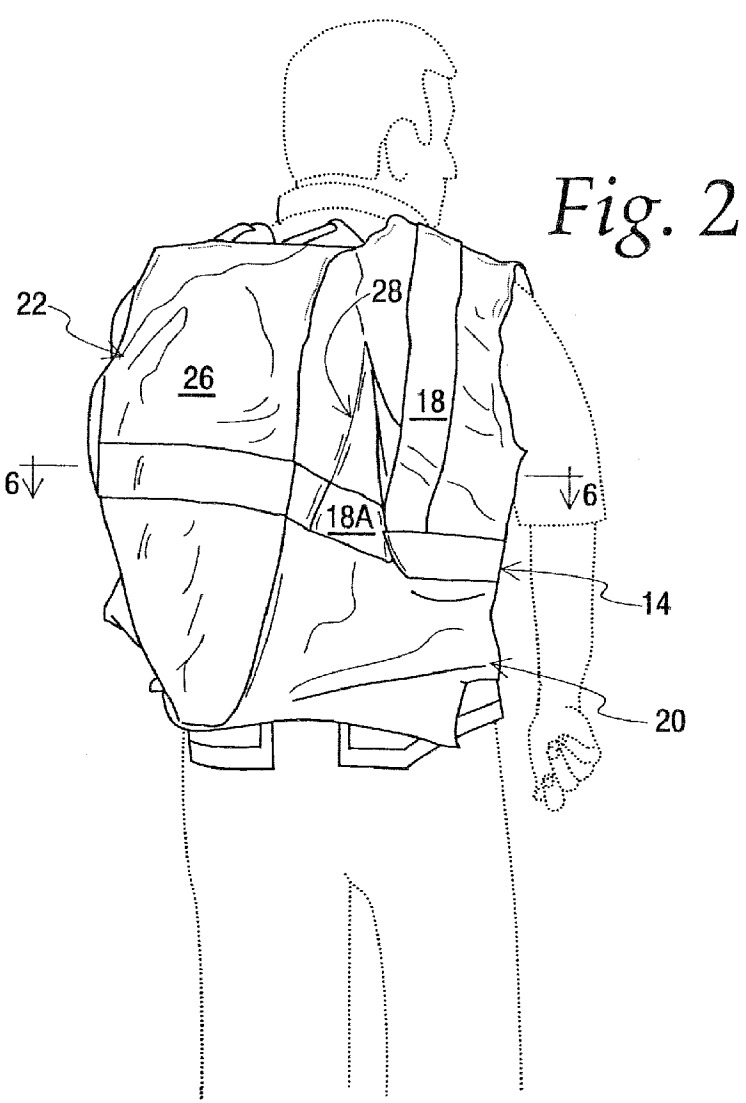
FIG. 2 is a perspective view from behind and to the right of the garment of FIG. 1 in a fully donned state.
Figure 1:
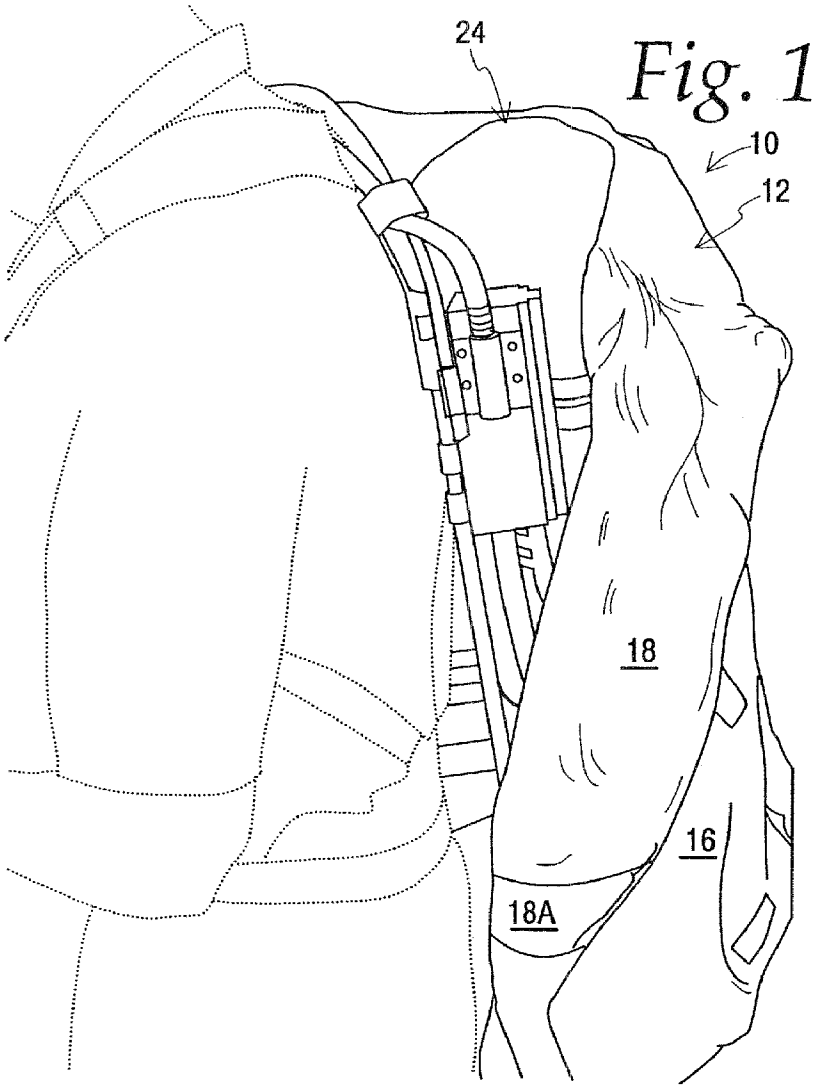
FIG. 1 is a perspective view from the side of a high visibility garment embodying the present invention shown in a partially donned state to expose an air/oxygen bottle worn by a wearer of the garment.

A high visibility safety garment 10 is shown in the form of a high visibility safety vest 12 having a torso covering portion 14 made of high visibility material 16, preferably a fluorescent yellow-green, a fluorescent orange-red or a fluorescent red, that completely encircles a wearer's torso. Additionally, retroreflective trim or strips 18 are also provided and include at least one retroreflective band 18A completely encircling the torso 14. Preferably, the garment 10 meets the current and/or any future standards under ANSI/ISEA 107 or ANSI/ISEA 207 (high visibility garment/vest standards developed by the International Safety Equipment Association (ISEA) and published by the American National Standards Institute, Inc.).

The torso covering portion 14 includes a back panel 20 with an air/oxygen bottle receiving cover 22 of the high visibility material 16 formed in the back panel 20 to cover an air/oxygen bottle 24 of an SCBA when worn by a wearer. The cover 22 can take many forms to provide the three dimensional structure required to cover an air/oxygen bottle of an SCBA with the high visibility material 16. Preferably, the band 18A extends over the entire circumferential width of the cover 22.

Figure 4:
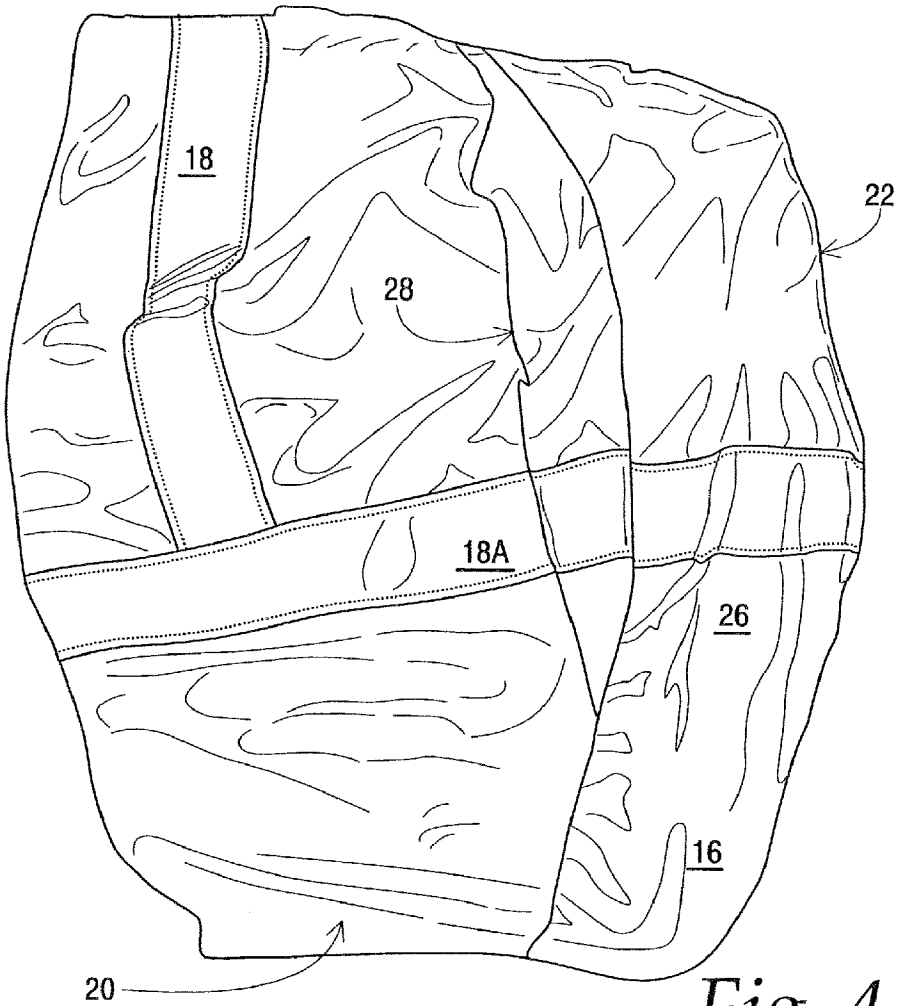
FIG. 4 is a perspective view from behind and to the left of the garment of FIG. 1.
Figure 3:
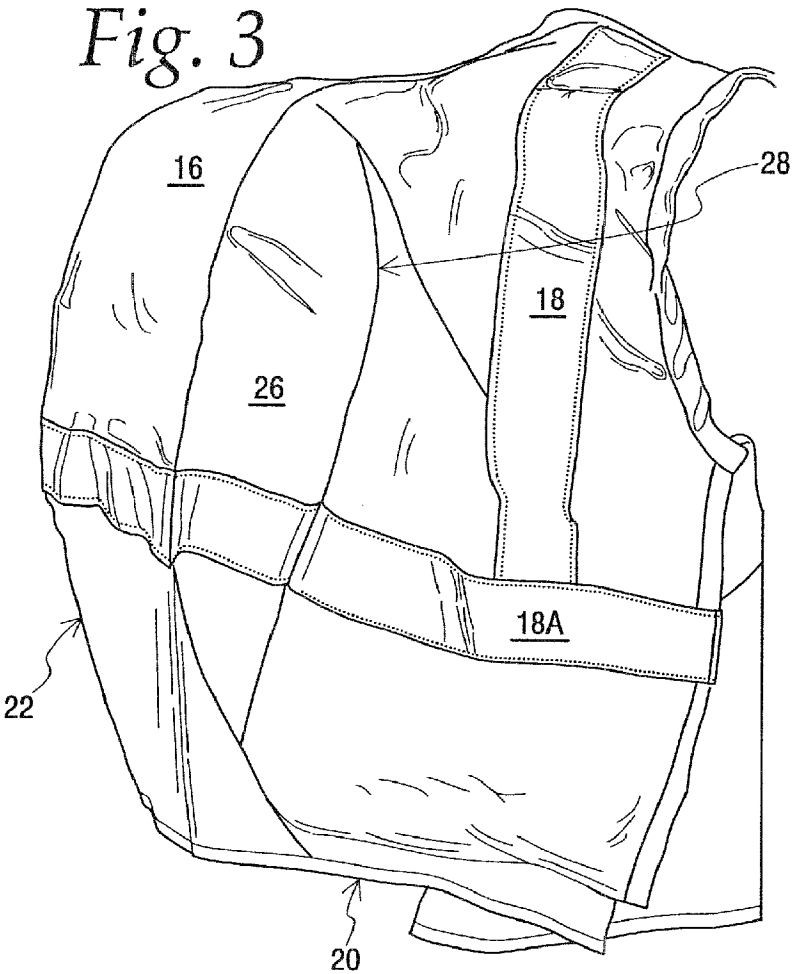
FIG. 3 is a perspective view similar to FIG. 2, but taken closer and more to the right.
Figure 5:
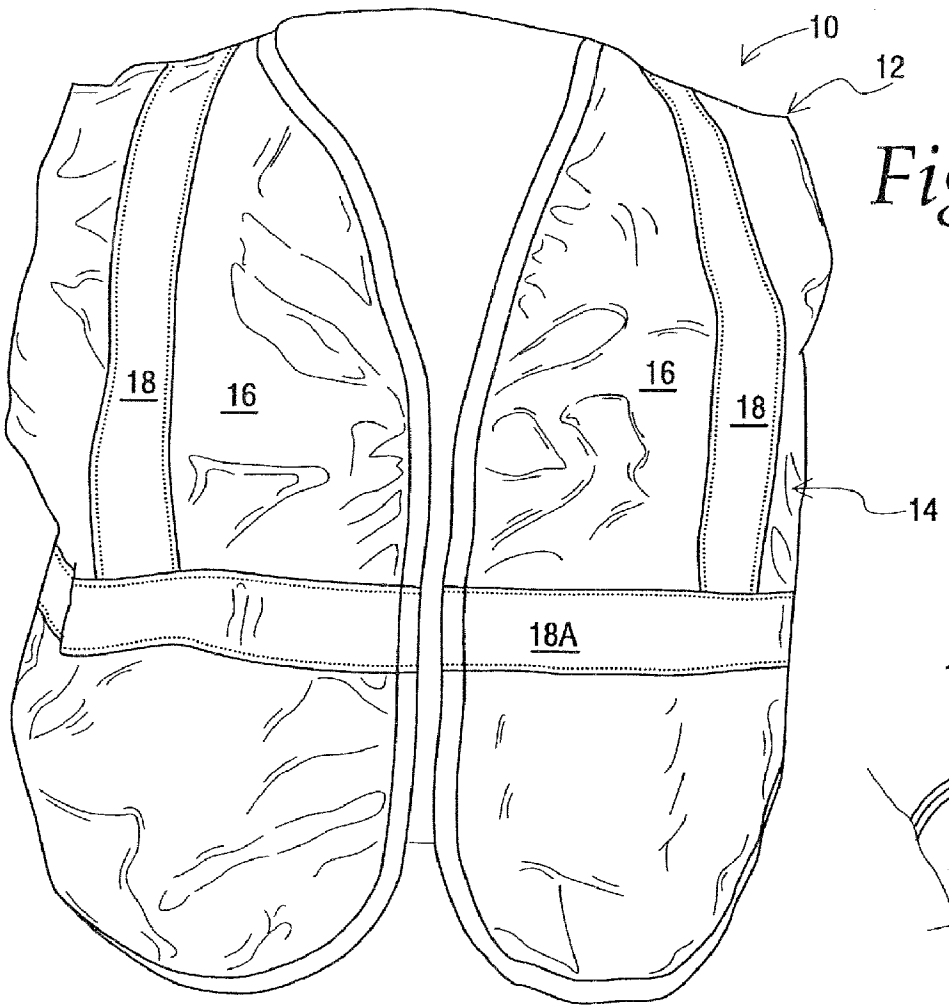
FIG. 5 is a front perspective view of the garment of FIG. 1.
Figure 6:
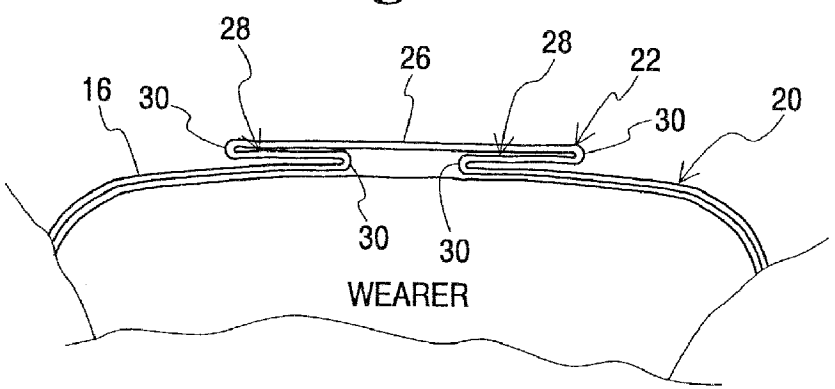
FIG. 6 is a section view taken from line 6-6 in FIG. 2, but showing the garment in an unexpanded state wherein an air/oxygen bottle is not worn by a wearer.

Preferably, the cover 22 includes an expandable portion 26 having an unexpanded state, such as shown in FIG. 6, wherein the expandable portion 26 lays against the remainder of the back panel 20 and a wearer that is not wearing an air/oxygen bottle 24, and an expanded state whereby the expandable portion 26 is expanded to cover an air/oxygen bottle 24 worn by a wearer, such as is shown in FIGS. 2-4. FIGS. 1-5 show one possible construction for the expandable portion 26 which includes a pair of spaced, parallel knife pleats 28 formed in the back panel 20 to extend longitudinally over the length of the back panel 20. Each pleat includes two folds 30 so that there are three layers of the material 16 at the pleat 28. In the unexpanded state, the pleats 28 are folded as shown in FIG. 6 and in the expanded state the pleats 28 are extended as shown in FIG. 2-3. While the spaced, parallel knife pleats 28 show one possible construction for the expandable cover, other constructions are also possible, including one or more box-type pleats extending longitudinally over the length of the back, or one or more triangular pleats extending longitudinally over the back, or one or more gussets provided in the back. Furthermore, while the expandable portion is shown as having an essentially rectangular shape defined between the pleats 28 and the top and bottom of the back panel 20, other shapes, such as square, oval, or triangular are possible and may be dictated by a number of parameters, such as, for example, the particular shape of the air/oxygen bottle.

While the expandable portion 26 is preferred, another possible construction is for the cover 22 to simply be a pocket that has only an expanded state and hangs empty when no air/oxygen bottle 24 is worn.

Optionally, the garment 10 can be adjustable in size to accommodate different size wearers and different garments the wearer may donned underneath the garment 10. One acceptable construction is shown in our co-pending application, filed concurrently herewith, naming the same inventors, titled "High Visibility Safety Apparel", and having attorney docket numbers HON10513P00010US and H0020786, which is incorporated herein by reference.

The invention claimed is:

1. A high visibility safety vest for use with an air/oxygen bottle such as used with a SCBA, the vest comprising:

a torso covering portion of high visibility material, the torso covering portion including a back panel with an air/oxygen bottle receiving cover of the high visibility material formed in the back panel to extend therefrom and cover an air/oxygen bottle of a SCBA worn by a wearer of the vest;

wherein the cover includes an expandable portion having an unexpanded state wherein the expandable portion lays flat against the remainder of the back panel and an expanded state wherein the expandable portion extends away from the remainder of the back panel to extend around an air/oxygen bottle worn by a wearer of the vest.

2. The vest of claim 1 wherein the expandable portion includes at least one pleat.

3. The vest of claim 2 wherein the at least one pleat is a knife edge pleat having two folds.

4. The vest of claim 1 wherein the expandable portion includes a pair eats.

5. The vest of claim 4 wherein the pleats extend parallel to each other.

6. The vest of claim 5 wherein the expandable portion is rectangular in shape.

7. The vest of claim 4 wherein each of the pleats is a knife edge pleat having two folds.

8. A high visibility safety vest for use with an air/oxygen bottle such as used with a SCBA, the vest comprising:

a torso covering portion of high visibility material, the torso covering portion including an expandable portion of the high visibility material located in a back of the torso covering portion and having an unexpanded state wherein the expandable portion lays flat with the remainder of the back against a wearer, and an expanded state wherein the expandable portion extends from the remainder of the back to cover an air/oxygen bottle worn by a wearer of the vest.

9. The vest of claim 8 wherein the expandable portion includes at least one pleat.

10. The vest of claim 9 wherein the at least one pleat is a knife edge pleat having two folds.

11. The vest of claim 8 wherein the expandable portion includes a pair of pleats.

12. The vest of claim 11 wherein the pleats extend parallel to each other.

13. The vest of claim 11 wherein each of the pleats is a knife edge pleat having two folds.

14. The vest of claim 8 wherein the expandable portion is rectangular in shape.

* * * * *